US008311421B2

(12) United States Patent
Handa

(10) Patent No.: US 8,311,421 B2
(45) Date of Patent: Nov. 13, 2012

(54) CONVEYER-MEMBER CONTROL DEVICE, IMAGE FORMING APPARATUS, AND DRIVE CONTROL METHOD

(75) Inventor: Seiichi Handa, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 718 days.

(21) Appl. No.: 12/425,775

(22) Filed: Apr. 17, 2009

(65) Prior Publication Data

US 2009/0274473 A1 Nov. 5, 2009

(30) Foreign Application Priority Data

May 2, 2008 (JP) ..... 2008-120441
Mar. 13, 2009 (JP) ..... 2009/061864

(51) Int. Cl.
*G03G 15/00* (2006.01)
*G03G 15/01* (2006.01)
*G03G 15/20* (2006.01)

(52) U.S. Cl. ..... 399/18; 399/301; 399/302; 399/308

(58) Field of Classification Search ..... 399/18, 399/302, 308, 301, 162
See application file for complete search history.

(56) References Cited

U.S. PATENT DOCUMENTS 7,133,630 B2 * 11/2006 Sakai ..... 399/301
2004/0197111 A1 10/2004 Kuroda
2005/0105937 A1 * 5/2005 Sakai ..... 399/301

FOREIGN PATENT DOCUMENTS

EP 1 517 192 A1 3/2005
JP 06-171794 * 6/1994
JP 2000-47547 2/2000
JP 3965357 6/2007
JP 2008-178276 7/2008

* cited by examiner

*Primary Examiner* — Judy Nguyen
*Assistant Examiner* — Blake A Tankersley
(74) *Attorney, Agent, or Firm* — Oblon, Spivak, McClelland, Maier & Neustadt, L.L.P.

(57) ABSTRACT

A detecting unit detects a conveying speed of a conveyer member. A driving unit drives the conveyer member. A first control unit performs a first feedback control of the conveying speed based on detected conveying speed and a predetermined target conveying speed. A second control unit detects a rotation speed of the driving unit and performs a second feedback control of the rotation speed based on detected rotation speed and a predetermined target rotation speed. When a determining unit determines that the detecting unit is anomalous, a switching unit switches from the first feedback control to the second feedback control.

11 Claims, 18 Drawing Sheets

"Related Art"

CONVEYER-MEMBER CONTROL DEVICE, IMAGE FORMING APPARATUS, AND DRIVE CONTROL METHOD

CROSS-REFERENCE TO RELATED APPLICATIONS

The present application claims priority to and incorporates by reference the entire contents of Japanese priority document 2008-120441 filed in Japan on May 2, 2008 and Japanese priority document 2009-061864 filed in Japan on Mar. 13, 2009.

BACKGROUND OF THE INVENTION

1. Field of the Invention

The present invention relates to a technology for controlling a conveying speed of a conveyer member in an image forming apparatus.

2. Description of the Related Art

A typical image forming apparatus, such as a multifunction product (MFP), forms a multiple-color image by superimposing toner images of multiple colors on a conveyer member on one another. A typical example of the conveyer member is a transfer belt. The MFP provides multiple functions as, e.g., a copier, a printer, a scanner, and a facsimile machine generally in a single enclosure. It is necessary to control the speed of the conveyer member so that the toner images are superimposed on one another appropriately.

More specifically, as depicted in FIG. 14, a drive motor 1402 rotates a drive roller 1404 that in turn rotates a transfer belt 1407 at a speed V. The transfer belt 1407 in turn rotates a driven roller 1403. A target frequency is set so that a rotation speed of the drive motor 1402 attains a target rotation speed. An encoder 1401 detects a pulse signal (Fb signal) indicative of a rotation speed of the driven roller 1403. A control unit 1406 controls the drive motor 1402 based on a result of comparison between the frequency of the pulse signal and a target frequency, and performs feedback control so that the transfer belt 1407 rotates at a constant speed.

An exemplary technique of such a feedback control for maintaining a rotation speed of a transfer belt constant is disclosed in Japanese Patent Application Laid-open No. 2000-47547. According to the technique, the feedback control is performed by comparing a component of speed that is generated due to eccentricity of a driven roller to a rotation speed of the transfer belt.

However, this approach is disadvantageous in that the encoder can fail to detect an accurate rotation speed if a trouble occurs with the encoder due to influences of dusts, electrical contact failure, a defective condition of the encoder itself, or the like. When such a trouble causes the encoder to detect rotation speed inaccurately, the rotating speed of the transfer belt becomes uncontrollable. This makes it disadvantageously necessary to stop the drive motor and the image forming apparatus to find a cause of the trouble and solve it.

SUMMARY OF THE INVENTION

It is an object of the present invention to at least partially solve the problems in the conventional technology.

According to one aspect of the present invention, there is provided a conveyer-member control device including a detecting unit that detects a conveying speed of a conveyer member; a driving unit that drives the conveyer member; a first control unit that performs a first feedback control of the conveying speed based on detected conveying speed and a predetermined target conveying speed; a second control unit that detects a rotation speed of the driving unit and performs a second feedback control of the rotation speed based on detected rotation speed and a predetermined target rotation speed; a determining unit that determines whether the detecting unit is anomalous based on the detected conveying speed while the first feedback control is performed; and a switching unit that switches, when determining unit determines that the detecting unit is anomalous, from the first feedback control to the second feedback control.

Furthermore, according to another aspect of the present invention, there is provided an image forming apparatus including a conveyer-member control device that controls a conveying speed of a conveyer member and an image forming unit that forms an image on the conveyer member. The conveyer-member control device includes a detecting unit that detects a conveying speed of a conveyer member, a driving unit that drives the conveyer member, a first control unit that performs a first feedback control of the conveying speed based on detected conveying speed and a predetermined target conveying speed, a second control unit that detects a rotation speed of the driving unit and performs a second feedback control of the rotation speed based on detected rotation speed and a predetermined target rotation speed, a determining unit that determines whether the detecting unit is anomalous based on the detected conveying speed while the first feedback control is performed, and a switching unit that switches, when the determining unit determines that the detecting unit is anomalous, from the first feedback control to the second feedback control.

Moreover, according to still another aspect of the present invention, there is provided a drive control method for a conveyer-member control device that includes a detecting unit that detects a conveying speed of a conveyer member and a driving unit that drives the conveyer member. The drive control method includes first controlling including performing a first feedback control of the conveying speed based on detected conveying speed and a predetermined target conveying speed; second controlling including detecting a rotation speed of the driving unit, and performing a second feedback control of the rotation speed based on detected rotation speed and a predetermined target rotation speed; determining whether the detecting unit is anomalous based on the detected conveying speed while the first feedback control is performed; and switching, when it is determined that the detecting unit is anomalous, from the first feedback control to the second feedback control.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings.

A first embodiment of the present invention is an image forming apparatus that has a printing function. Examples of the image forming apparatus include what-is-called a multi-function product (MFP) that and provides multiple functions as, e.g., a copier, a printer, a scanner, and a facsimile machine generally in a single enclosure. Note that the first embodiment will be described based on an MFP 1000 as an exemplary image forming apparatus; however, the exemplary image forming apparatus is not limited to the MFP 1000, and can be an arbitrary apparatus that includes the printing function.

Figure 1:
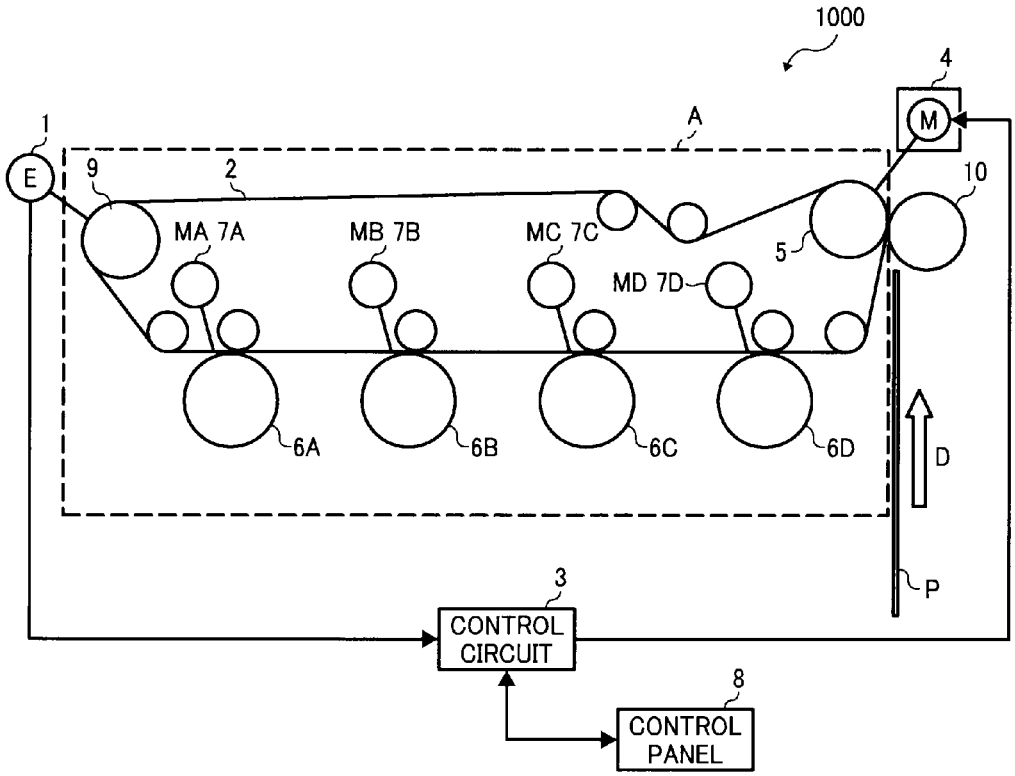
FIG. 1 is a schematic diagram of relevant parts of an MFP according to a first embodiment of the present invention.

FIG. 1 is a schematic diagram of relevant parts of the MFP 1000. The MFP 1000 includes an encoder 1, an intermediate transfer belt 2, a control circuit 3, a direct current (DC) servomotor 4, a drive roller 5, photosensitive drums 6A, 6B, 6C, and 6D, photosensitive-drum drive rollers 7A, 7B, 7C, and 7D, a control panel 8, a driven roller 9, and a secondary transfer roller 10.

The encoder 1 is a speed sensor that detects a rotation speed of the driven roller 9 and outputs the detected rotation speed as a digital signal. More specifically, the encoder 1 detects an Fb signal, which is a pulse signal indicative of a conveying speed of the intermediate transfer belt 2, and transmits the Fb signal to the control circuit 3 and to the DC servomotor 4. Even after a signal for use in feedback control has been switched from the Fb signal to a frequency-generator (FG) signal, the encoder 1 continues to transmit the Fb signal to the control circuit 3.

The Fb signal will be described below. A rotating slit member is arranged on a rotary shaft of the driven roller 9. Slits are defined in the rotating slit member at regular intervals. Light that passes through the rotating slit member is intermittently received by a light receiving element. Upon receipt of the light, the light receiving element outputs a pulse signal, which is the Fb signal. Because the rotation speed of the driven roller 9 is proportional to the conveying speed of the intermediate transfer belt 2, the Fb signal is a pulse signal indicative of the conveying speed of the intermediate transfer belt 2.

The intermediate transfer belt 2 is an endless belt that is wound around the drive roller 5 and the driven roller 9. The intermediate transfer belt 2 carries thereon toner images of multiple colors. The toner images are electrostatically charged by the photosensitive drums 6A, 6B, 6C, and 6D and then superimposed on one another on the intermediate transfer belt 2. As the drive roller 5 rotates, the driven roller 9 is rotated counterclockwise.

The control circuit 3 receives the Fb signal from the encoder 1. When a pulse period of the Fb signal is out of a period range, the control circuit 3 determines that the Fb signal is anomalous, and switches feedback control from feedback control by using the Fb signal (hereinafter, "Fb control") to feedback control by using the FG signal (hereinafter, "FG control").

The FG signal will be described below. The FG signal is a pulse signal that is generated by, for example, utilizing a fact that when a rotor rotates across a stator in a motor M of the DC servomotor 4, a counter electromotive force is generated across a coil of the stator. In synchronization with changes in the counter electromotive force, a frequency generator generates a pulse signal, which is the FG signal. Put another way, frequency of an FG signal is proportional to a rotation speed of the motor M.

The DC servomotor 4 includes the motor M and a control system that performs feedback control of the motor M by using an Fb signal or an FG signal, which will be described later in detail with reference to FIG. 2.

The motor M rotates the drive roller 5 that in turn causes the intermediate transfer belt 2 supported by the drive roller 5 and the driven roller 9 to rotate. The intermediate transfer belt 2 in turn causes the driven roller 9 to rotate.

The drive roller 5 is a roller that is rotated by the DC servomotor 4 to convey the intermediate transfer belt 2 in a conveying direction.

The photosensitive drums 6A, 6B, 6C, and 6D are in contact with the intermediate transfer belt 2 and carries thereon toner images having been formed by a developing unit (not shown) based on latent images. While the photosensitive drums 6A, 6B, 6C, and 6D are rotated by the photosensitive-drum drive rollers 7A, 7B, 7C, and 7D, the toner images are transferred onto the intermediate transfer belt 2.

The photosensitive-drum drive rollers 7A, 7B, 7C, and 7D are motors that rotate the photosensitive drums 6A, 6B, 6C, and 6D.

The control panel 8 includes a display device such as a liquid crystal display (LCD), and receives an instruction for performing printing from a user through a touch interface or the like. When a pulse period of an Fb signal fed from the encoder 1 is out of the period range, an indication that the Fb signal is anomalous or that detection of the speed of the intermediate transfer belt 2 by the encoder 1 is anomalous is displayed on the control panel 8.

The control panel 8 can additionally have a function of receiving an instruction, which is to be entered by a user in response to the indication, for switching the Fb control to the FG control through the touch interface of the control panel 8 or the like.

The driven roller 9 is a roller that supports the intermediate transfer belt 2 therearound and driven to rotate the intermediate transfer belt 2. The intermediate transfer belt 2 is rotated by rotations of the drive roller 5 and the driven roller 9 in the conveying direction.

The secondary transfer roller 10 is a roller by way of which the toner images on the intermediate transfer belt 2 are collectively transferred onto the transfer paper P. The transfer paper P is conveyed in a direction D.

The control circuit 3 and the DC servomotor 4 will be described below in detail. FIG. 2 is a block diagram of the control circuit 3 and the DC servomotor 4 depicted in FIG. 1.

The control circuit 3 includes a target setting unit 310, a memory-for-determination 320, a switching unit 330, a comparative determining unit 340, and an operation control unit 350.

The memory-for-determination 320 stores therein a target frequency f0, a target pulse period T0, a period range of the Fb signal, and an allowable time interval between consecutive two pulse outputs of the Fb signal. The memory-for-determination 320 also stores therein the number (hereinafter, "anomaly count") of times that an Fb signal is determined to be anomalous as a history record. The memory-for-determination 320 also stores therein a threshold count N. When the anomaly count is smaller than the threshold count N, even when an Fb signal is determined to be anomalous, only the anomaly count is incremented and switching of the feedback control is not performed. The threshold count N is set to, for example, one, two, or three, depending on a model of the image forming apparatus and preset in advance before shipping.

The target frequency f0 is a target frequency of the Fb signal in the feedback control for causing the intermediate transfer belt 2 to rotate at a target conveying-speed. The target pulse period T0 is a target pulse period of the Fb signal in the feedback control.

The period range of the target pulse period T0 is set such that if an Fb signal fed from the encoder 1 is normal, a pulse period of the Fb signal falls within the period range. The period range can be, for example, 80 percent to 120 percent of the target pulse period T0. In this example, if the target pulse period T0 is 1.0 millisecond, when a pulse period of an Fb signal falls within the period range, more specifically, when the pulse period is equal to or longer than 0.8 millisecond and equal to or shorter than 1.2 milliseconds, the Fb signal is determined to be normal. In contrast, when the pulse period is out of the period range, more specifically, when the pulse period is shorter than 0.8 millisecond or longer than 1.2 milliseconds, the Fb signal is determined to be anomalous.

The allowable time interval is set to, for example, a period 20 percent longer than the target pulse period T0. In this example, when a pulse output of an Fb signal is not detected for a duration equal to or longer than 1.2 milliseconds, the Fb is out of the period range, and determined to be anomalous.

Figure 3:
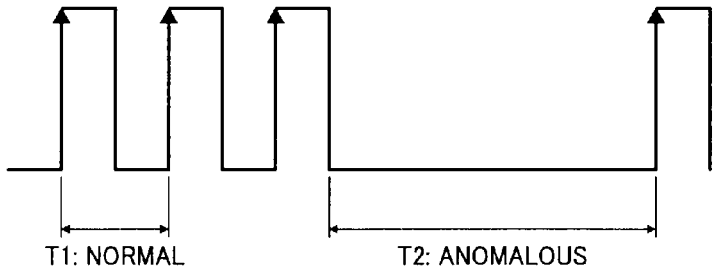
FIG. 3 is a schematic diagram for explaining an Fb signal in a duration where the Fb signal is normal and a duration where the Fb signal is anomalous.

The comparative determining unit 340 determines whether an Fb signal is normal based on the Fb signal and the target pulse period T0 at a predetermined condition, e.g., at a startup or a restart, or at regular time intervals. More specifically, as depicted in FIG. 3, when a pulse output of an Fb signal is detected with a normal pulse period T1, the Fb signal is determined as normal. When a subsequent pulse output of the Fb signal is detected after a duration T2, which is longer than the allowable time interval having been set in advance, the comparative determining unit 340 determines that the Fb signal is anomalous.

After the feedback control has been switched to the FG control, the comparative determining unit 340 determines whether the Fb signal has recovered to normal at predetermined timing. More specifically, when a pulse period of the Fb signal falls within the period range, the comparative determining unit 340 determines that the Fb signal has recovered to normal. Alternatively, the comparative determining unit 340 can determine that the Fb signal has recovered to normal only upon detection of the Fb signal.

The comparative determining unit 340 stores the anomaly count, which is the number of times that an Fb signal is determined to be anomalous, as a historical record in the memory-for-determination 320. The comparative determining unit 340 determines whether the anomaly count has exceeded the threshold count N.

It has been mentioned above that whether the Fb signal fed from the encoder 1 is anomalous is determined based on a result of determination as to whether a pulse period of the Fb signal falls within the period range. Alternatively, an Fb signal can be determined to be normal based on only a fact that a pulse output of the Fb signal is detected in disregard of a pulse period of the Fb signal.

When an instruction for starting printing is entered from the control panel 8 by a user, the target setting unit 310 fetches the target frequency f0 from the memory-for-determination 320 and stores the target frequency f0 in a memory-for-setting 410. The memory-for-setting 410 is arranged in the DC servomotor 4.

When the Fb signal is determined to be anomalous by the comparative determining unit 340 and the anomaly count is determined to have exceeded the threshold count N, the switching unit 330 does not stop the DC servomotor 4 even while printing is performed. Rather than stopping the DC servomotor 4, the switching unit 330 transmits a switching signal to an FG control unit 430. Upon receipt of the switching signal, the FG control unit 430 causes a switch 450 to switch the feedback control to the FG control.

Even when the Fb signal is determined to be anomalous by the comparative determining unit 340, when the anomaly count is equal to or below the threshold count N, the switching unit 330 causes the control panel 8 to display an indication that the Fb signal is anomalous rather than switching the feedback control. The switching unit 330 can be constructed to additionally operate as follows. In response to the displayed indication about the anomaly, an instruction for switching the Fb control to FG control can be entered by a user through a touch interface of the control panel 8 or the like. Upon receipt of the instruction, the switching unit 330 transmits a switching signal for switching the feedback control from the Fb control to the FG control.

Even when the Fb signal is determined to be anomalous by the comparative determining unit 340, if thereafter the Fb signal is determined to have recovered to normal, the switching unit 330 transmits a switching signal for switching the feedback control from the FG control back to the Fb control to an encoder control unit 420 of the DC servomotor 4.

This return switching permits the feedback control to immediately return to the Fb control. Why it is desirable to return the feedback control back from the FG control to the Fb control will be described. The conveying speed of the intermediate transfer belt 2 can be controlled more accurately by the Fb control than by the FG control. More specifically, there can be circumstances where a piece of thick board paper is fed by the drive roller 5 or where even though the rotation speed of the motor M is constant, the conveying speed of the intermediate transfer belt 2 fluctuates due to thermal expansion of the driven roller 9. In such a circumstance, the FG control fails to control the conveying-speed accurately. In contrast to the FG control, the Fb control is performed by using an Fb signal indicative of an actual value of the conveying-speed. Accordingly, the conveying-speed can be controlled more accurately by the Fb control.

It has been mentioned above that the DC servomotor 4 issues the switching signal while the DC servomotor 4 is driven, i.e., while printing is performed. Alternatively, a time when the switching signal is to be issued can be set as desired by a user. For example, the switching signal can be issued, when an Fb signal is determined to be anomalous, while the DC servomotor 4 is stopped temporarily. The switching signal can be issued after a predetermined duration even during a driving period of the DC servomotor 4. The switching signal can be issued immediately when an Fb signal is determined to be anomalous.

When the target setting unit 310 has stored the target frequency f0 in the memory-for-setting 410, the operation control unit 350 converts the target frequency f0 into an analog voltage by using an frequency/voltage (F/V) converter (not shown). The operation control unit 350 controls the rotation speed of the motor M by controlling a voltage applied across the motor M, or the like method. The operation control unit 350 causes an engine unit (not shown) of the MFP 1000 to start operations such as printing and scanning that are to be performed by application software. When the operations performed by the application software are completed, the operation control unit 350 causes the DC servomotor 4 and the engine unit to stop.

Figure 2:
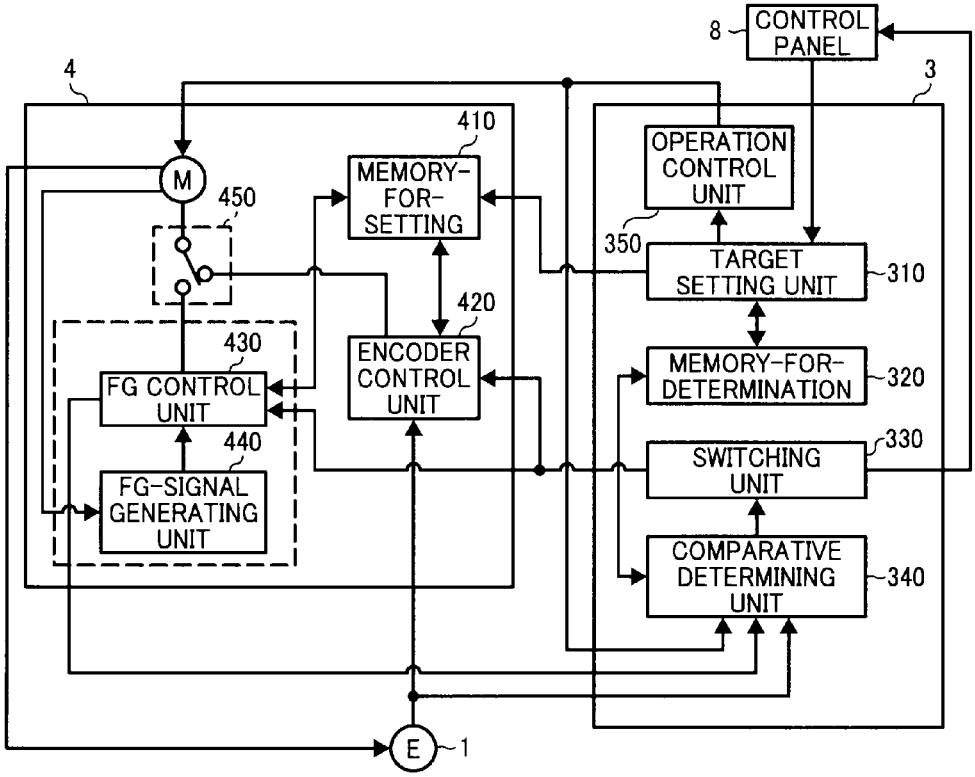
FIG. 2 is a block diagram of the relevant parts of the MFP depicted in FIG. 1.

As depicted in FIG. 2, the DC servomotor 4 includes the memory-for-setting 410, the encoder control unit 420, the FG control unit 430, an FG-signal generating unit 440, the switch 450, and the motor M.

The memory-for-setting 410 stores therein the target frequency f0 that is set by the target setting unit 310.

The encoder control unit 420 receives an Fb signal from the encoder 1, and performs feedback control of the rotation speed of the motor M so that the pulse period of the Fb signal attains the target pulse period T0 stored in the memory-for-setting 410.

An Fb signal is a pulse signal indicative of the conveying speed of the intermediate transfer belt 2. The target pulse period T0 is a target pulse period of Fb signals in the feedback control for controlling the conveying speed of the intermediate transfer belt 2 to a target conveying-speed. In the mechanism explained above, the conveying speed of the intermediate transfer belt 2 is proportional to the rotation speed of the motor M.

Hence, put another way, the encoder control unit 420 performs feedback control of the conveying speed of the intermediate transfer belt 2 by using a detected value of the conveying speed of the intermediate transfer belt 2 and the target value of the same.

When the encoder control unit 420 receives, from the switching unit 330 of the control circuit 3, a switching signal (e.g., a binary value such as "0") for switching the feedback control to the Fb control, the encoder control unit 420 causes the switch 450 to operate and connect the motor M to the encoder control unit 420 to perform the Fb control.

The FG control unit 430 receives an FG signal from the FG-signal generating unit 440, and performs feedback control of the rotation speed of the motor M so that the pulse period of the FG signal attains the target pulse period T0 stored in the memory-for-setting 410. Upon receipt of a switching signal (e.g., a binary value such as "1") for switching the feedback control to the FG control, the FG control unit 430 causes the switch 450 to operate and connect the motor M to the FG control unit 430 to perform the FG control.

The FG-signal generating unit 440 includes a frequency generator. The FG-signal generating unit 440 generates an FG signal, which is a pulse signal proportional to the rotation speed of the motor M, and transmits the FG signal to the FG control unit 430.

The motor M is a DC servomotor that rotates the drive roller 5. The motor M is connected via the switch 450 to either the encoder control unit 420 or the FG control unit 430. When the motor M is connected to the encoder control unit 420, the rotation speed of the motor M is under the Fb control. When the motor M is connected to the FG control unit 430, the rotation speed of the motor M is under the FG control.

The switch 450 includes a relay circuit. The switch 450 operates to connect the motor M to any one of the encoder control unit 420 and the FG control unit 430 according the switching signal.

Figure 4A:
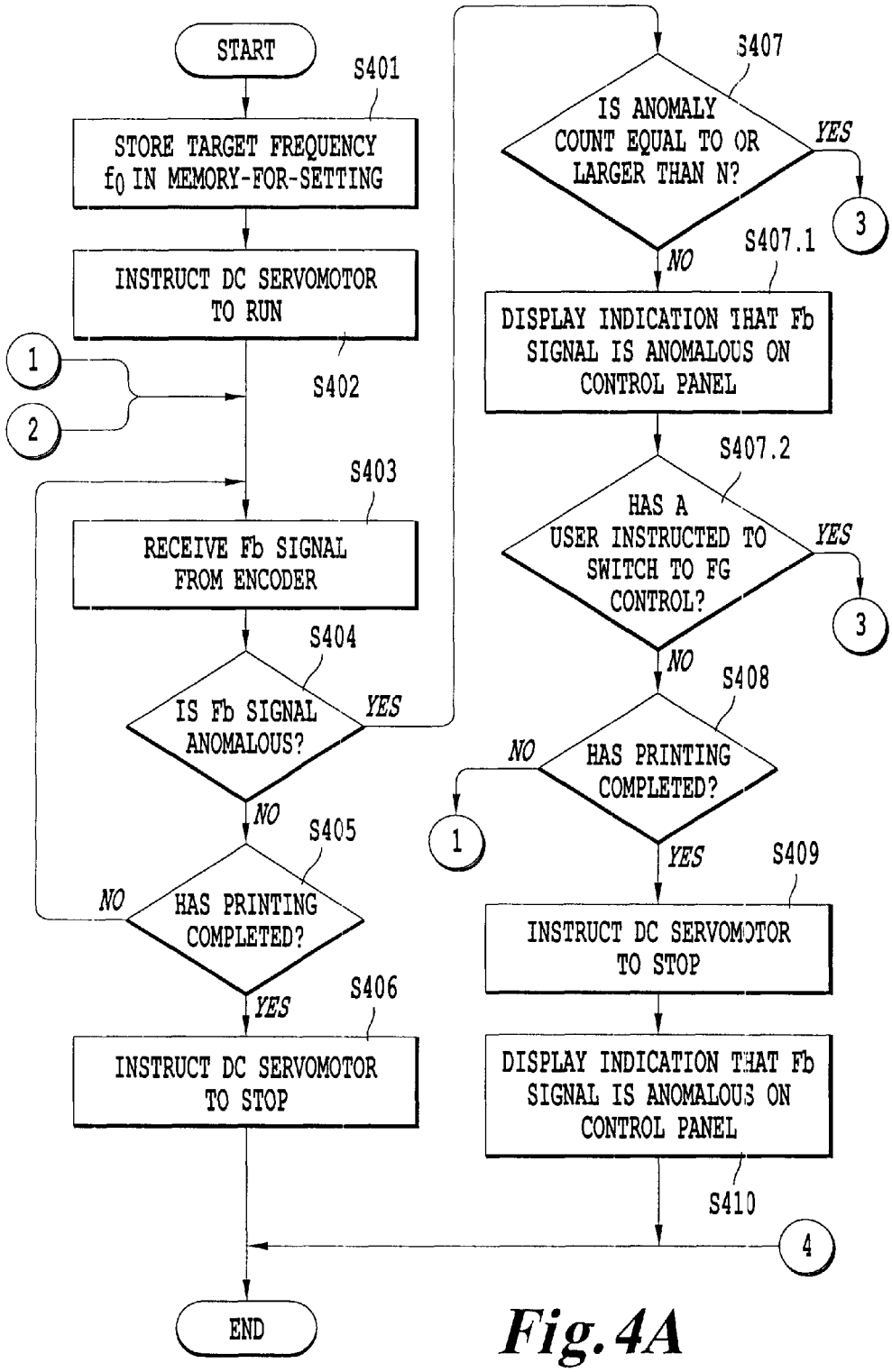
FIG. 4 is a flowchart of operations to be performed by the MFP depicted in FIG. 1 before feedback control is switched.
Figure 4B:
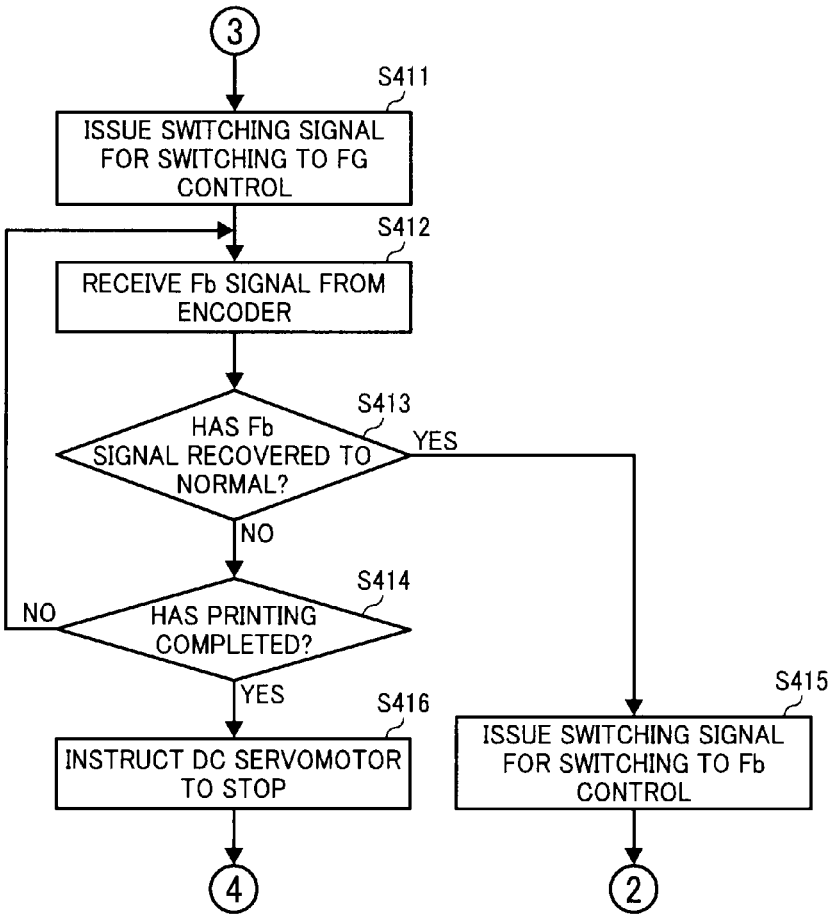

How the MFP 1000 operates will be described below. FIG. 4 is a flowchart of operations to be performed by the MFP 1000 after receiving an instruction for starting printing from a user until the DC servomotor 4 is stopped to complete the printing.

When an instruction for starting printing is entered by a user from the control panel 8, the target setting unit 310 stores a target frequency f0 in the memory-for-setting 410 (Step S401). The operation control unit 350 causes the motor M to run according to the target frequency f0 (Step S402). The drive roller 5 is rotated by the motor M, which in turn rotates the driven roller 9 and accordingly rotates the intermediate transfer belt 2. The encoder 1 detects an Fb signal that is generated along with rotation of the driven roller 9. The comparative determining unit 340 receives the Fb signal from the encoder 1 (Step S403). Whether the Fb signal is anomalous is determined by comparing the Fb signal to the period range stored in the memory-for-determination 320 (Step S404).

When the comparative determining unit 340 determines that the Fb signal is normal (No at Step S404), the motor M is continued to be subjected to the Fb control.

After the printing has completed and the operation control unit 350 receives a notification of completion of the printing from printing application software (Yes at Step S405), the operation control unit 350 stops the motor M, and brings operations performed by the printing application software to end (Step S406). When the printing has not completed yet and the operation control unit 350 has not received the notification yet (No at Step S405), the system control returns to Step S403 to continue the printing under the Fb control.

When the comparative determining unit 340 has determined that the received Fb signal is anomalous (Yes at Step S404), the comparative determining unit 340 determines whether the anomaly count is equal to or larger than the threshold count N (Step S407).

When the comparative determining unit 340 has determined that the anomaly count is smaller than the threshold count N (No at Step S407), the Fb control is continued. There is a displayed an indication that the Fb signal is anomalous on the control panel in step S407.1. Next flow proceeds to step S407.2 which determines whether a user has instructed to switch to Fg control. If Yes in step 407.2, flow preceeds to step S411 at the top of FIG. 4*b*. If the determination is NO in step S407.2, it is determined in step S408 whether printing has been completed. At this time, if the printing has not completed yet (No at Step S408) in a manner similar to that described for Step S405, the system control returns to Step S403 to continue the printing under the Fb control. If the printing has completed (Yes at Step S408), the operation control unit 350 stops the motor M to complete the operations performed by the printing application software in a manner similar to that described for Step S406 (Step S409). The switching unit 330 causes the control panel 8 to display an indication that the Fb signal is anomalous (Step S410).

When the anomaly count is determined to have exceeded the threshold count N by the comparative determining unit 340 (Yes at Step S407), the switching unit 330 transmits to the FG control unit 430 a switching signal for switching the feedback control to the FG control (Step at S411). Upon receipt of the switching signal, the FG control unit 430 operates the switch 450 to connect the FG control unit 430 to the motor M. Even after the FG control unit 430 has been connected to the motor M by using the switch 450, the encoder 1 continues to transmit the Fb signal to the control circuit 3.

The comparative determining unit 340 continues to receive the Fb signal (Step S412), and determines whether the Fb signal has recovered to normal at predetermined timing (Step S413). When the Fb signal is determined to have recovered to normal (Yes at Step S413), the switching unit 330 transmits a switching signal for switching the feedback control to the Fb control to the encoder control unit 420 (Step S415). System control then returns to Step S403 to repeat the system control at Step S403 and subsequent steps.

When the Fb signal is not determined to have recovered to normal (No at Step S413), the FG control is continued. When the printing has not completed yet (No at Step S414), in a manner similar to that described for Step S405, the system control returns to Step S412 to continue the printing under the FG control. When the printing has completed (Yes at Step S414), the motor M is stopped to bring the processing performed by the printing application software to end in a manner similar to that described for Step S406. Upon completion of the system control at Step S416, all the operations for implementing the first embodiment end.

It has been mentioned above that the switching unit 330 issues the switching signal immediately after the Fb signal has recovered to normal, thereby switching the FG control back to the Fb control. Alternatively, the number of times (hereinafter, "recovery count") that the Fb signal is determined to have recovered to normal can be stored so that the switching unit 330 switches the FG control back to the Fb control when the recovery count reaches a predetermined value.

In this manner, in the MFP 1000 according to the first embodiment, the feedback control of the motor M is performed while switching the feedback control between the Fb control and the FG control. Accordingly, the conveying speed of the intermediate transfer belt 2 can be controlled without stopping the intermediate transfer belt 2 even when an anomaly occurs with the encoder 1.

The MFP 1000 continues to monitor the Fb signal even after the feedback control has been switched to the FG control so that the MFP 1000 can switch the feedback control back to the Fb control immediately when the Fb signal has recovered to normal. This permits automatic recovery of the feedback control to the Fb control when the Fb signal has been detected to be anomalous due to a temporary cause of anomaly. Examples of the temporary cause include dusts on the encoder 1 and electrical contact failure. Put another way, even when the encoder 1 is determined to be anomalous, it is possible to automatically return the feedback control to the Fb control. Because the Fb control can control the conveying speed of the intermediate transfer belt 2 more accurately than the FG control, the MFP 1000 can advantageously form high-quality images.

How to switch the feedback control when an Fb signal is determined to be anomalous has been mentioned by way of the procedure to be operated by the MFP 1000 after receiving an instruction for starting printing from a user until the printing is completed. However, in an actual operation, it is in some cases necessary to power off an MFP to solve a trouble, such as paper jam, that occurs during printing. The printing is resumed after the trouble has been solved. To cope with such an occasion, an MFP 2000 according to a second embodiment of the present invention stores a current feedback control state in a nonvolatile memory or the like. The MFP 2000 can resume the feedback control according to the stored state when the MFP 2000 is powered on again.

Figure 5:
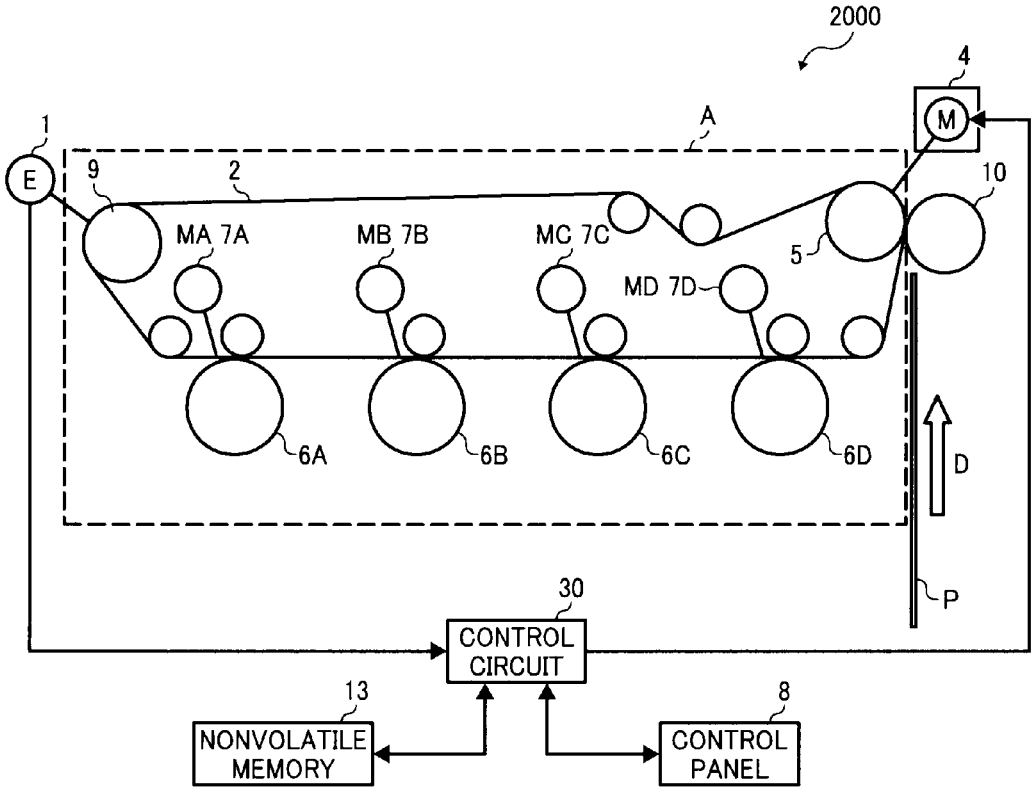
FIG. 5 is a schematic diagram of relevant parts of an MFP according to a second embodiment of the present invention.

FIG. 5 is a schematic diagram of relevant parts of the MFP 2000. The MFP 2000 differs from the MFP 1000 in including a control circuit 30 that differs from the control circuit 3 and additionally including a nonvolatile memory 13. Like components to those of the first embodiment are denoted by the same reference numerals and repeated descriptions are avoided.

The nonvolatile memory 13 includes a nonvolatile memory such as a flash memory. An FG control flag indicative of a state of the feedback control is stored in the nonvolatile memory 13. The FG control flag indicates which one of the Fb control and the FG control is currently performed. For example, an FG control flag "1" indicates that the Fb control is performed, while an FG control flag "0" indicates that the FG control is performed. The anomaly count, which is the number of times that the Fb signal is determined to be anomalous by the comparative determining unit 340, is also stored in the nonvolatile memory 13.

Figure 6:
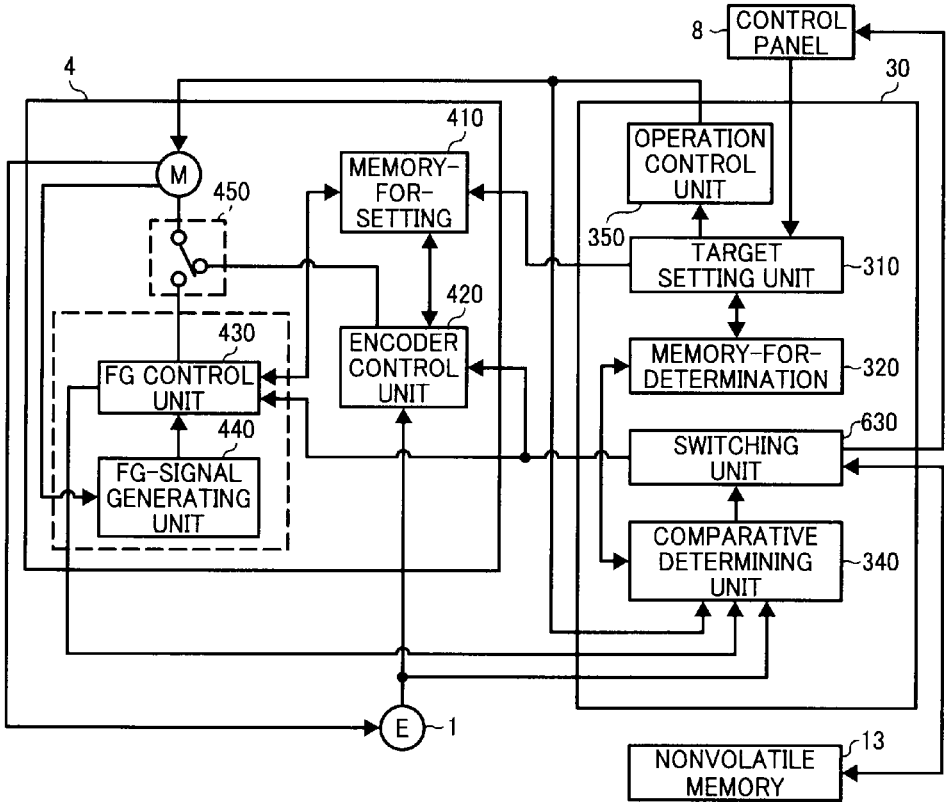
FIG. 6 is a block diagram of the relevant parts of the MFP depicted in FIG. 5.

The control circuit 30 will be described below. FIG. 6 is a block diagram of the control circuit 30. The control circuit 30 differs from the control circuit 3 in including a switching unit 630 that differs from the switching unit 330.

The switching unit 630 has, in addition to functions similar to those of the switching unit 330, the following function. When an Fb signal is determined to be anomalous, the switching unit 630 sets an FG control flag to, for example, "1", based on the switching signal that is transmitted to the FG control unit 430. By storing the FG control flag in the nonvolatile memory 13, the switching unit 630 stores information that tells that the FG control is to be performed. Simultaneously, the switching unit 630 stores the anomaly count in the nonvolatile memory 13 as a history record.

When an Fb signal is determined to be anomalous, and thereafter the Fb signal has recovered to normal, the switching unit 630 resets the FG control flag to, for example, "0". By storing the FG control flag in the nonvolatile memory 13, the switching unit 630 stores information that tells that the Fb control is to be performed. Simultaneously, the switching unit 630 resets the anomaly count stored in the nonvolatile memory 13.

Figure 7A:
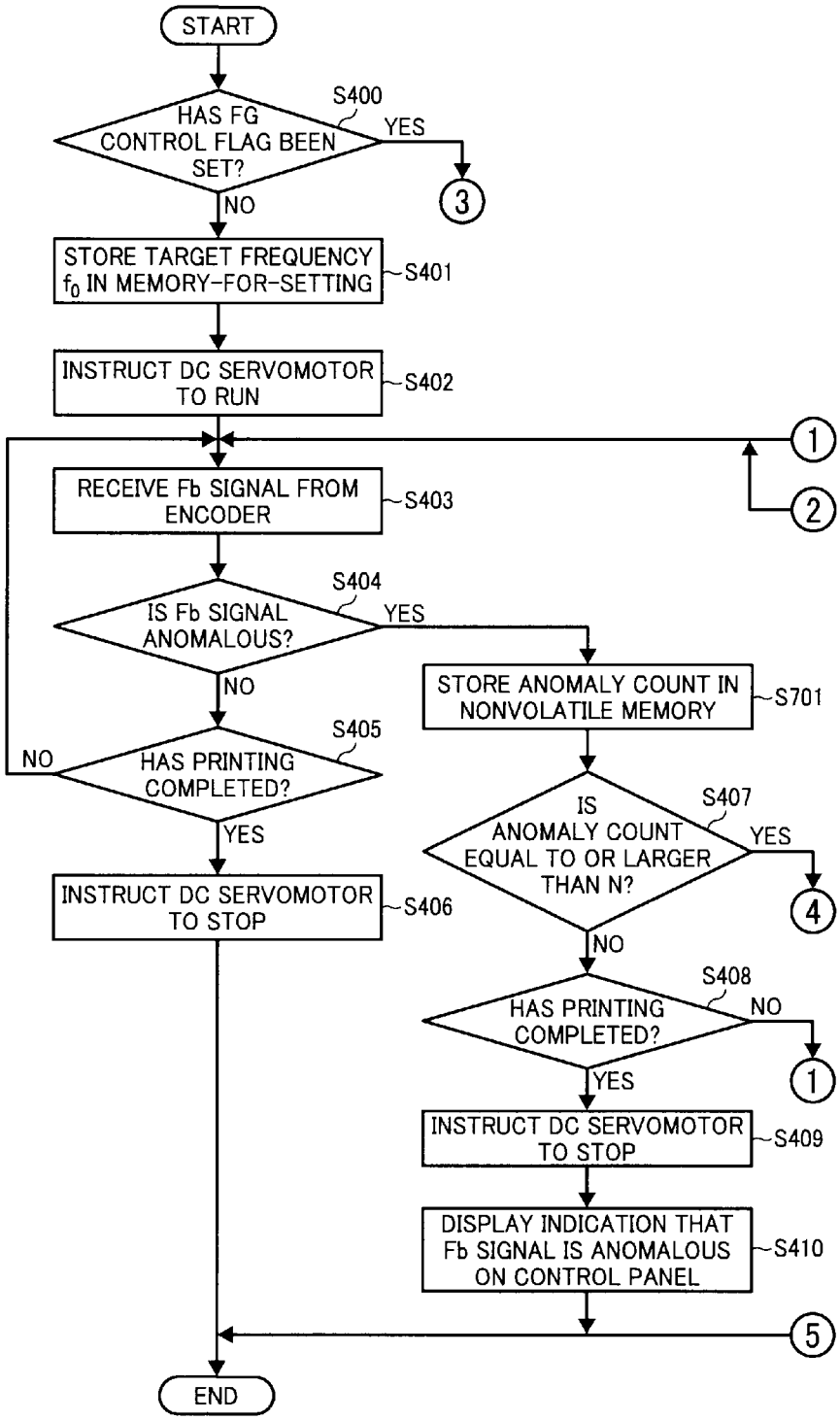
FIG. 7 is a flowchart of operations to be performed by the MFP depicted in FIG. 5 before feedback control is switched.
Figure 7B:
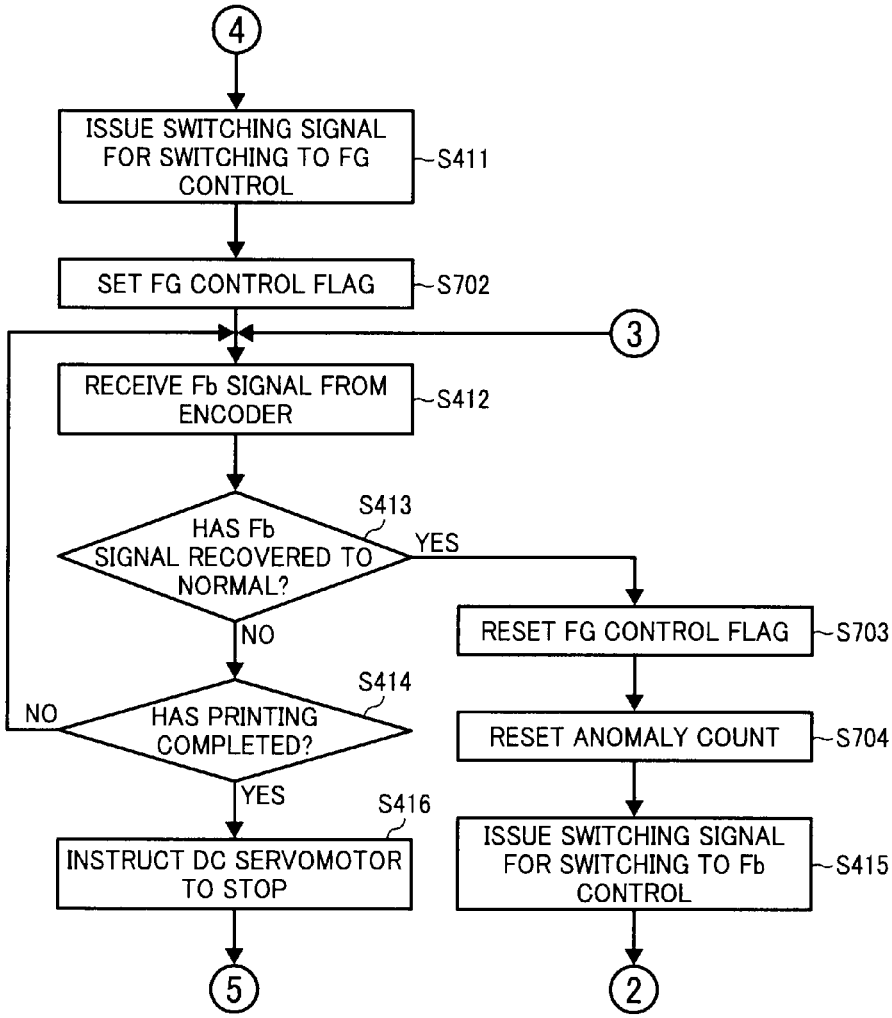

How the MFP 2000 operates will be described below with reference to FIG. 7. The procedure performed by the MFP 2000 differs from that performed by the MFP 1000 only in that, in the MFP 2000, an FG control flag and an anomaly count are stored in the nonvolatile memory 13. At other steps than steps related to this, the system control performed by the MFP 2000 is the same as that of the MFP 1000, the other steps are denoted by the same step numbers and repeated descriptions are avoided.

The comparative determining unit 340 determines whether an FG control flag has been set (Step S400) When an FG control flag has been set (Yes at Step S400), the system control proceeds to Step S412 to cause the motor M to run under FG control. When an FG control flag has not been set (No at Step S400), the system control proceeds to Step S401 to cause the motor M to run under Fb control.

When the comparative determining unit 340 determines that a received Fb signal is anomalous based on a result of comparison between the Fb signal and the period range stored in the memory-for-determination 320 (Yes at Step S404), the switching unit 630 increments an anomaly count in the nonvolatile memory 13 (Step S701). Thereafter, the system control at Step S407 and subsequent steps are performed.

The switching unit 630 outputs a switching signal for switching the feedback control to the FG control to the FG control unit 430 (Step S411), and sets an FG control flag according to the switching signal (Step S702).

When the Fb signal is determined to have recovered to normal (Yes at Step S413), the switching unit 630 resets the FG control flag (Step S703). The switching unit 630 further resets the anomaly count stored in the nonvolatile memory 13 (Step S704). Thereafter, the system control at Step S415 and subsequent steps are performed.

In this manner, according to the second embodiment, the feedback control state and the anomaly count are stored in the nonvolatile memory 13. Hence, the MFP 2000 is advantageous in that even when the MFP 2000 is restarted and the encoder 1 is determined to be anomalous, it is possible to start the motor M immediately by selecting the feedback control according to the stored feedback control state while controlling the conveying speed of the intermediate transfer belt 2.

In the MFP according to the first or the second embodiment, when an Fb signal is determined to be anomalous, the feedback control is switched without stopping the DC servomotor 4, that is, while printing is performed. However, when the feedback control is switched while printing is performed, transmission of control signals is temporarily discontinued. This can make it difficult to superimpose toner images of different colors accurately on one another. To this end, an MFP 3000 according to a third embodiment of the present invention switches the feedback control upon completion of an ongoing print job of printing being performed by the MFP 3000.

Figure 8:
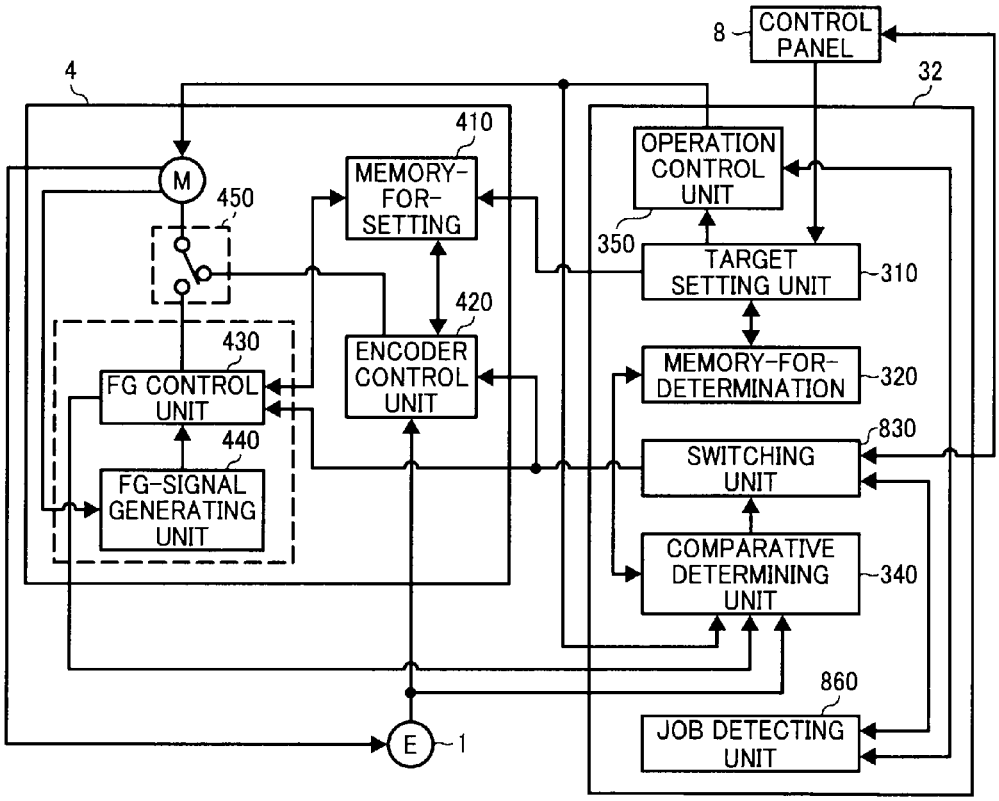
FIG. 8 is a block diagram of relevant parts of an MFP according to a third embodiment of the present invention.

FIG. 8 is a block diagram of relevant parts of the MFP 3000. The MFP 3000 differs from the MFP 1000 according to the first embodiment in including a control circuit 32 that differs from the control circuit 3. More specifically, the control circuit 32 differs from the control circuit 3 in including a switching unit 830 that differs from the switching unit 330 and additionally including a job detecting unit 860. Like components to those of the first embodiment are denoted by the same reference numerals and repeated descriptions are avoided.

The switching unit 830 has, in addition to functions similar to those of the switching unit 330, the following function. When the job detecting unit 860 has detected completion of an ongoing print job of printing performed by printing application software, the switching unit 830 issues a switching signal for switching the feedback control to the FG control.

The job detecting unit 860 monitors status of the printing performed by the printing application software and detects completion of an ongoing print job of the printing.

Figure 9A:
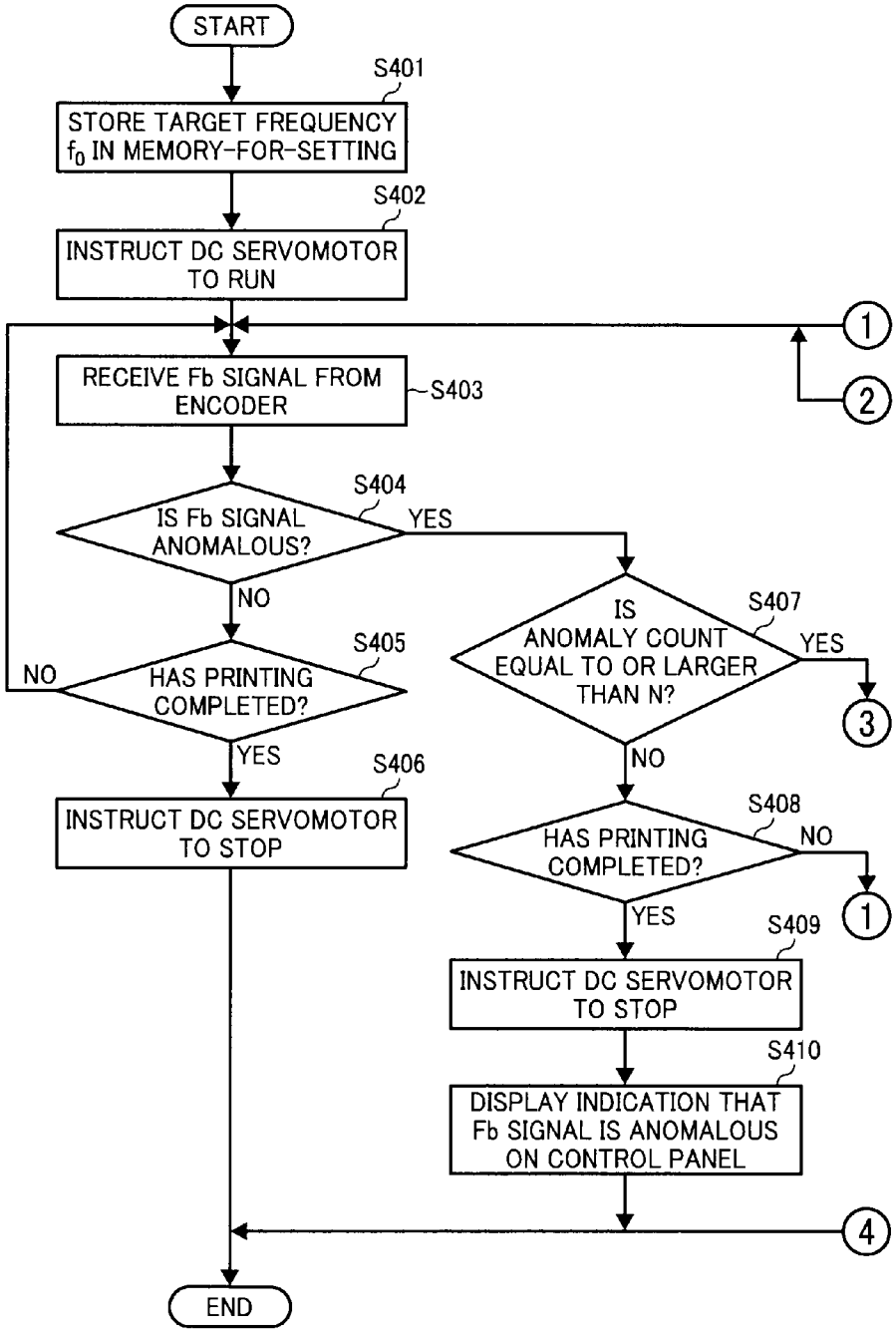
FIG. 9 is a flowchart of operations to be performed by the MFP according to the third embodiment before feedback control is switched.
Figure 9B:
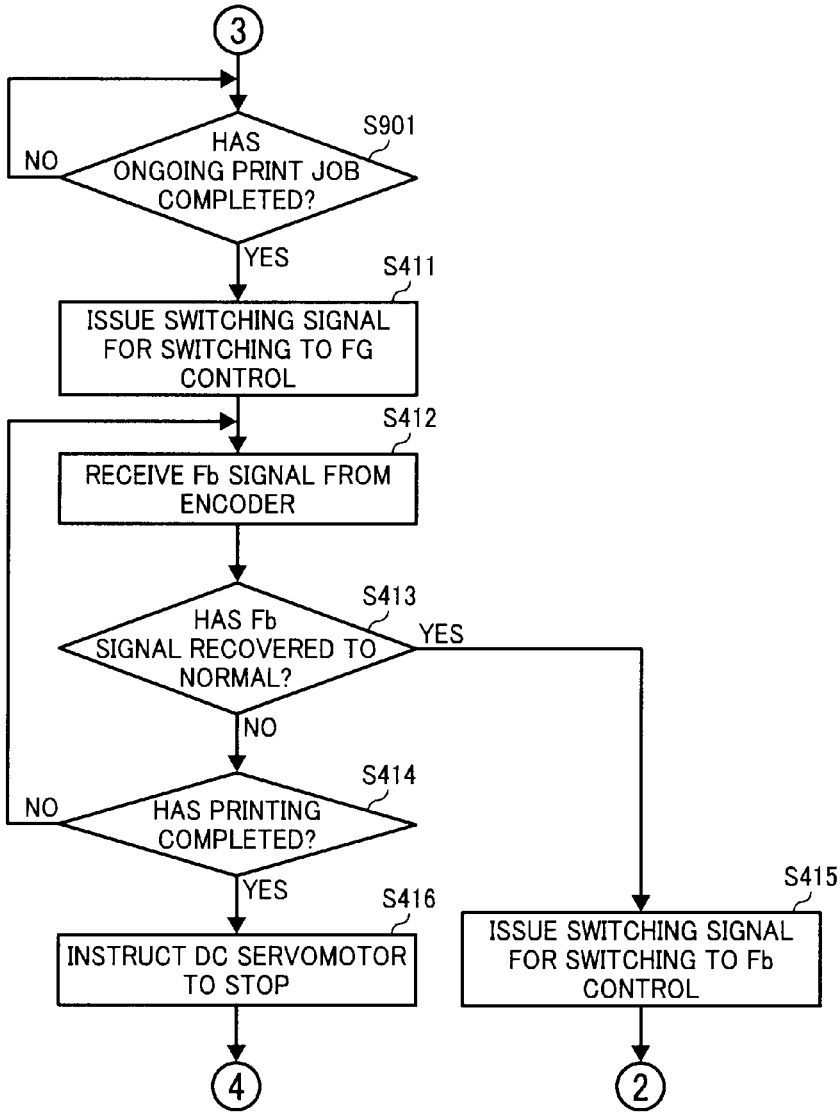

How the MFP 3000 operates will be described below with reference to FIG. 9. The procedure performed by the MFP 3000 differs from that performed by the MFP 1000 only in that a switching signal is issued upon completion of an ongoing job. At other steps than steps related to this, the system control performed by the MFP 3000 is the same as that of the MFP 1000, the other steps are denoted by the same step numbers and repeated descriptions are avoided.

When the comparative determining unit 340 has determined that the anomaly count exceeds the threshold count N (Yes at Step S407), the job detecting unit 860 monitors a status of printing to detect completion of an ongoing print job (Step S901). When the ongoing print job has not completed yet (No at Step S901), the job detecting unit 860 waits for completion of the ongoing print job. When the job detecting unit 860 has detected completion of the ongoing print job (Yes at Step S901), the switching unit 830 issues a switching signal for switching the feedback control to the FG control (Step S411).

In this manner, in the MFP 3000 according to the third embodiment, the job detecting unit 860 detects completion of an ongoing print job of printing performed by the MFP 3000 so that the feedback control is switched upon completion of the ongoing print job. Accordingly, the third embodiment is advantageous in that toner images of different colors are prevented from being superimposed inaccurately on one another and that the conveying speed of the intermediate transfer belt 2 can be controlled immediately.

It has been mentioned above that the switching unit 830 switches the feedback control immediately when the job detecting unit 860 has detected completion of an ongoing print job in a condition where the comparative determining unit 340 has determined that the anomaly count has exceeded the threshold count N. As a modification of this embodiment, the control circuit 32 can additionally include a switching determining unit 831. The switching determining unit 831 determines when to perform switching of the feedback control depending on the severity of anomaly of an Fb signal detected by the encoder 1. For example, the switching determining unit 831 determines, depending on the severity, to perform the switching either after completion of an ongoing print job or immediately without waiting for completion of the ongoing print job.

More specifically, the memory-for-determination 320 preferably stores therein a first period range and a second period range. In consideration of such an anomaly that a time interval between two consecutive pulse outputs of an Fb signal is out of the first period range, the second period range is set to have an allowable range larger than that of the first period range. When the period ranges are set in this manner, the switching determining unit 831 determines to switch the feedback control after completion of an ongoing print job when a pulse period of an Fb signal is out of the first period range but falls within the second period range. The switching determining unit 831 determines to switch the feedback control immediately without waiting for completion of the ongoing print job when the pulse period has exceeded the second period range.

In this manner, when an Fb signal is determined to be anomalous, when to switch the feedback control can be set depending on the severity of anomaly of the Fb signal. If an Fb signal is determined to be anomalous and severity of anomaly of the Fb signal is great, the feedback control is switched immediately. Accordingly, it is possible to avoid a more severe status where printing cannot be performed any more. If an Fb signal is determined to be anomalous but severity of anomaly of the Fb signal is small, the feedback control is switched after completion of an ongoing print job. Accordingly, it is possible to protect an image being formed from adverse effects that can develop when control signals are switched. Hence, the third embodiment is advantageous in permitting high-quality images as well as smooth printing.

In the MFP 3000 according to the third embodiment, the feedback control is switched upon completion of an ongoing print job to control the conveying speed of the intermediate transfer belt 2 while preventing misalignment error in superimposition of toner images. However, when the number of pages to be printed by an ongoing print job is considerably large, a waiting time before completion of the ongoing job can be long. In such a case, even when an Fb signal is determined to be anomalous, the feedback control is continued by using the Fb signal. To this end, an MFP 4000 according to a fourth embodiment of the present invention switches the feedback control upon completion of printing of one page of an ongoing print job.

Figure 10:
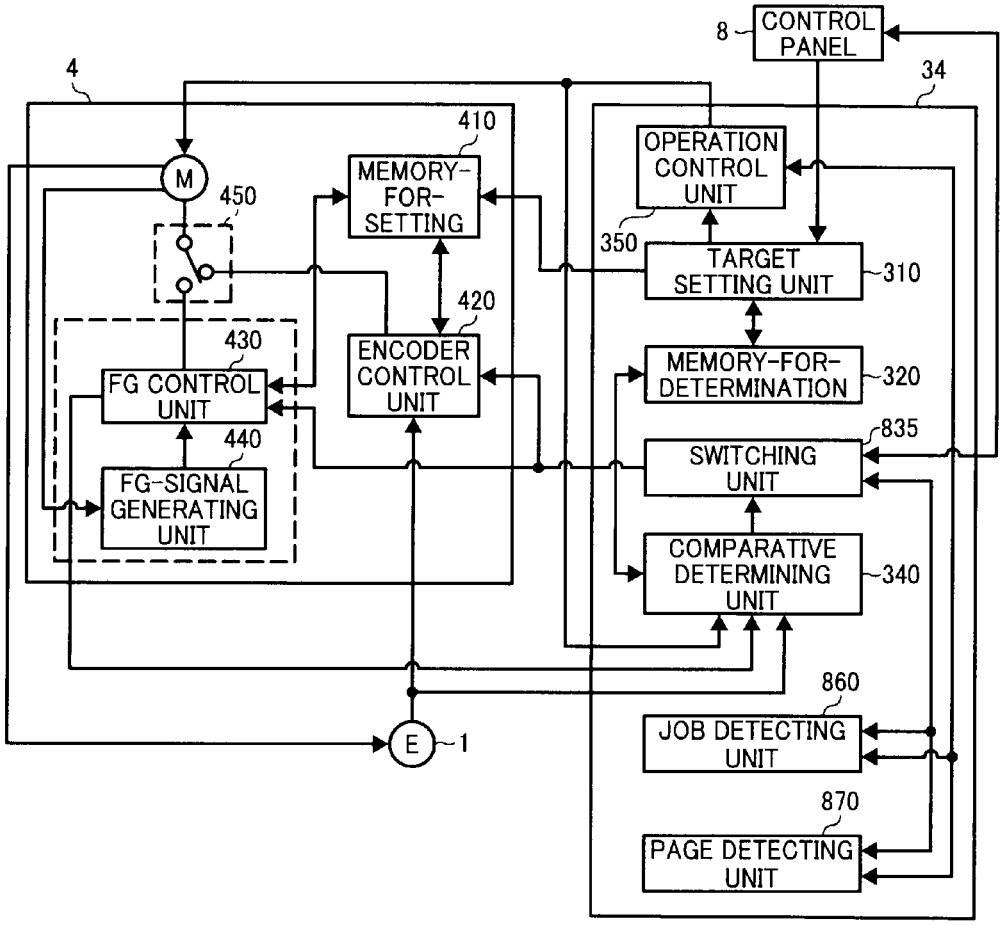
FIG. 10 is a block diagram of relevant parts of an MFP according to a fourth embodiment of the present invention.

FIG. 10 is a block diagram of relevant parts of the MFP 4000. The MFP 4000 differs from the MFP 3000 according to the third embodiment in including a control circuit 34 that differs from the control circuit 32. The control circuit 34 differs from the control circuit 32 in including a switching unit 835 that differs from the switching unit 830 and additionally including a page detecting unit 870. Like components to those of the third embodiment are denoted by the same reference numerals and repeated descriptions are avoided.

The switching unit 835 has, in addition to functions similar to those of the switching unit 830, the following function. When the page detecting unit 870 has detected completion of printing of a currently-printing page of an ongoing print job of printing performed by printing application software, the switching unit 835 issues a switching signal for switching the feedback control to the FG control.

The page detecting unit 870 monitors status of the printing performed by the printing application software and detects completion of a currently-printing page of an ongoing print job.

Figure 11A:
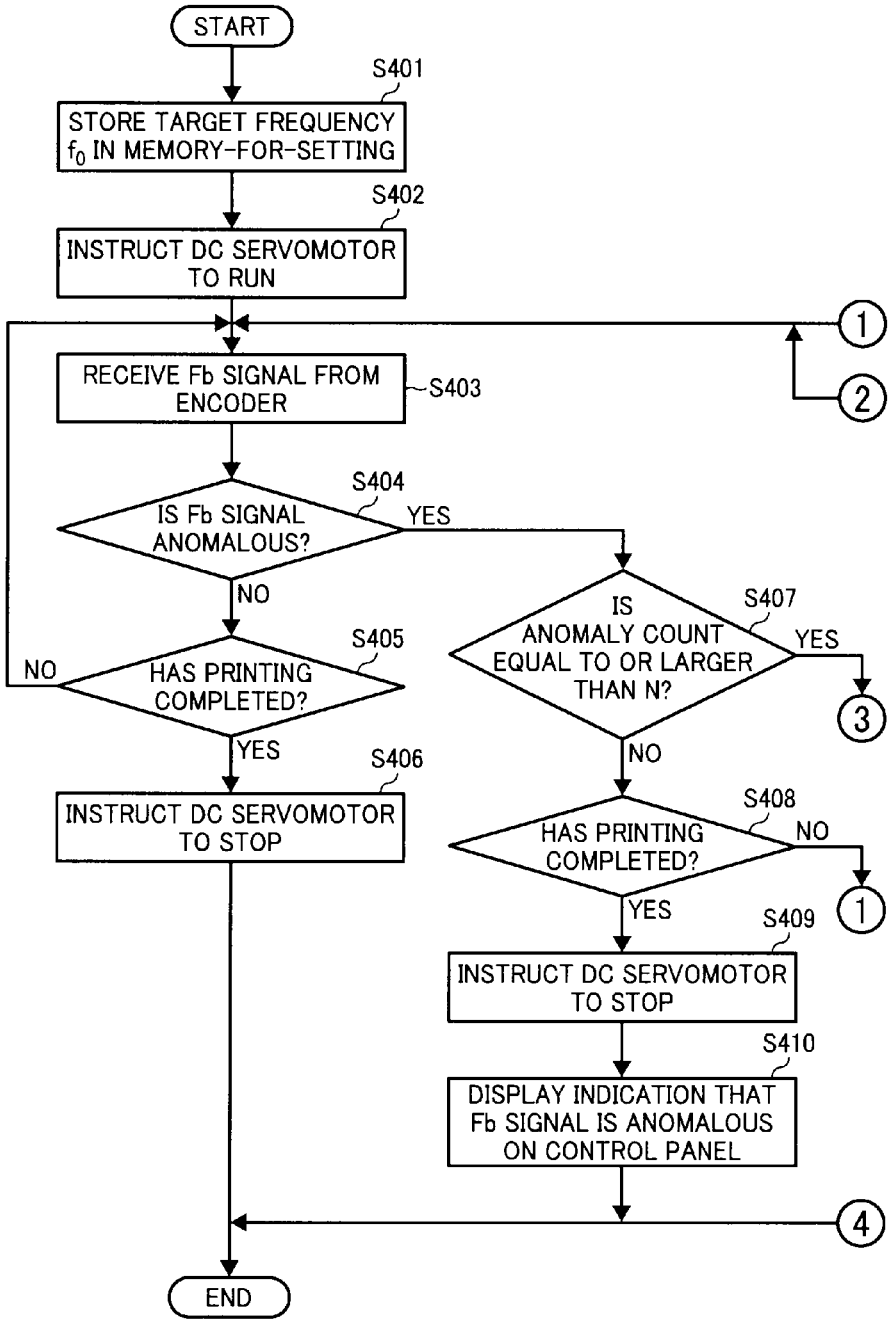
FIG. 11 is a flowchart of operations to be performed by the MFP according to the fourth embodiment before feedback control is switched.
Figure 11B:
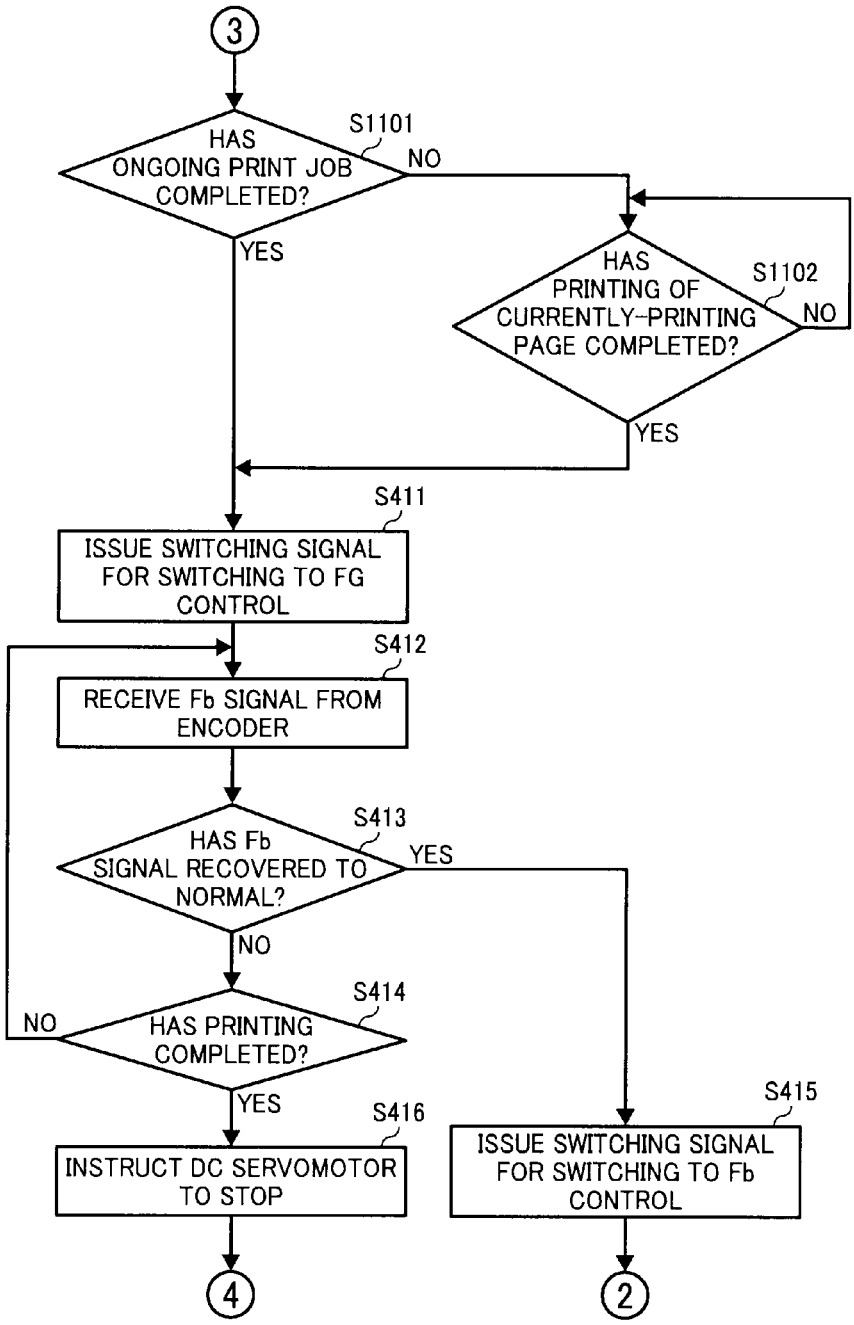

How the MFP 4000 operates will be described below with reference to FIG. 11. The procedure performed by the MFP 4000 differs from that performed by the MFP 3000 only in that a switching signal is issued upon completion of printing of a currently-printing page of an ongoing job. At other steps than steps related to this, the system control performed by the MFP 4000 is the same as that of the MFP 3000, the other steps are denoted by the same step numbers and repeated descriptions are avoided.

When the job detecting unit 860 has not detected completion of an ongoing print job yet (No at Step S1101) in a condition where the comparative determining unit 340 has determined that the anomaly count has exceeded the threshold count N (Yes at Step S407), whether printing of a currently printing page has completed is determined based on a result of detection by the page detecting unit 870 (Step S1102).

When the page detecting unit 870 has detected completion of printing of the currently-printing page (Yes at Step S1102), the switching unit 830 issues a switching signal for switching the feedback control to the FG control (Step S411). When the page detecting unit 870 has not detected completion of printing of the currently-printing page yet (No at Step S1102), the system control returns to Step S1102 to wait for completion of printing of the currently-printing page.

When the job detecting unit 860 has detected completion of the ongoing print job (Yes at Step S1101), the system control proceeds to step S411 where the switching unit 830 issues a switching signal for switching the feedback control to the FG control.

In this manner, the page detecting unit 870 detects completion of printing of a currently-printing page so that the feedback control is switched upon completion of the printing of the currently-printing page. Accordingly, the fourth embodiment is advantageous in that switching of the feedback control can be performed at an earlier point in time than in the third embodiment according to which the switching is performed after completion of an entire ongoing print job while avoiding misalignment error in superimposition of toner images.

In the MFPs 1000 to 4000, the feedback control is switched when a pulse period of an Fb signal is out of the period range and accordingly the Fb signal is determined to be anomalous irrespective of whether multiple-color printing or monochrome printing is to be performed. Meanwhile, because a multi-color image is formed by superimposing toner images of different colors on one another, it is necessary to control the conveying speed of the intermediate transfer belt 2 in multiple-color printing more accurately than in monochrome printing. Simultaneously, it is also necessary to consider when to switch the feedback control. In contrast, because superimposition of multiple toner images is not performed in monochrome printing, a monochrome image of sufficient quality can be formed even when the conveying-speed is controlled by using the FG signal. In view of this, the FG control has conventionally been performed in monochrome printing. Even when the feedback control is switched to the FG control immediately when an Fb signal is determined to be anomalous during monochrome printing, magnitude of an adverse effect on an image quality exerted by the FG control is not large. Accordingly, in an MFP 5000 according to a fifth embodiment of the present invention, high priority is placed on smooth printing. More specifically, in the MFP 5000, the feedback control in monochrome printing is switched sooner than in the other embodiments by setting period ranges individually for different printing modes. An allowable range of a period range for monochrome printing is smaller than that for multiple-color printing.

Figure 12:
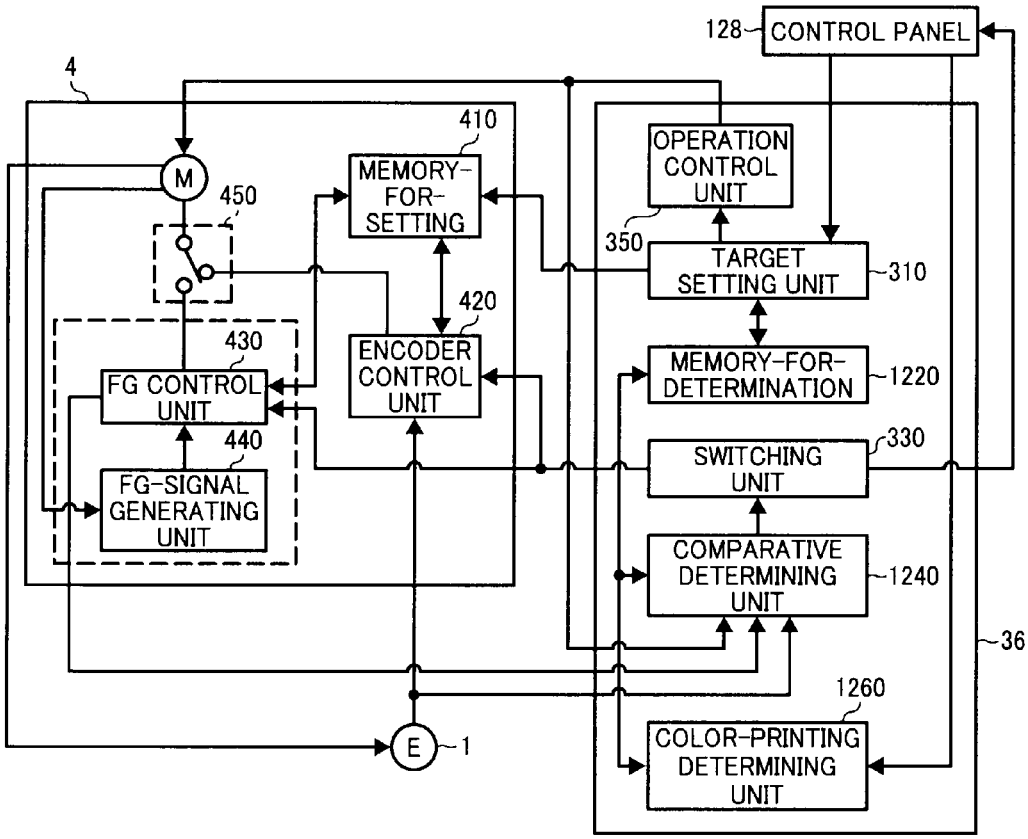
FIG. 12 is a block diagram of relevant parts of an MFP according to a fifth embodiment of the present invention.

FIG. 12 is a block diagram of relevant parts of the MFP 5000. The MFP 5000 differs from the MFP 1000 according to the first embodiment in including a control circuit 36 that differs from the control circuit 3 and a control panel 128 that differs from the control panel 8. More specifically, the control circuit 36 differs from the control circuit 3 in including a memory-for-determination 1220 and a comparative determining unit 1240, and additionally including a color-printing determining unit 1260. The memory-for-determination 1220 differs from the memory-for-determination 320. The comparative determining unit 1240 differs from the comparative determining unit 340. Like components to those of the third embodiment are denoted by the same reference numerals and repeated descriptions are avoided.

The control panel 128 displays an indication thereon and receives an instruction in a manner similar to that of the control panel 8. In addition, the control panel 128 receives a designation as to whether multiple-color printing or monochrome printing is to be performed.

The memory-for-determination 1220 stores therein, in addition to data similar to that of the memory-for-determination 320, period ranges for an Fb signal. The period ranges are set individually for different printing modes. For example, the memory-for-determination 1220 stores therein a period range for an Fb signal for multiple-color printing (hereinafter, "color-printing range") and a period range for an Fb signal for monochrome printing (hereinafter, "monochrome-printing range"). The color-printing range and the monochrome-printing range are individually mapped to printing modes. Data that indicates a selected printing mode is received from the control panel 128 and stored in the memory-for-determination 1220.

The monochrome-printing range is smaller than the color-printing range. More specifically, for example, when the color-printing range is set to be from 80 percent to 120 percent of the target pulse period T0, the monochrome-printing range is set to be from 90 percent to 110 percent of the target pulse period. In this example, if the target pulse period T0 is 1.0 millisecond, the color-printing range is from 0.8 millisecond to 1.2 milliseconds, while the monochrome-printing range is from 0.9 millisecond to 1.1 milliseconds. When anomaly detection is performed based on the monochrome-printing range, an Fb signal is determined to be anomalous at an earlier stage than in anomaly detection based on the color-printing range.

In this manner, when anomaly is detected at an early stage of pulse period drift of an Fb signal, the anomaly count accumulates to reach the threshold count N sooner than in detection based on the color-printing range. Accordingly, because the feedback control is switched to the FG control sooner, degradation in image quality due to pulse period drift of the Fb signal can be prevented sooner than in detection based on the color-printing range.

It has been mentioned that whether an Fb signal is anomalous is determined by using the two period ranges, i.e., the monochrome-printing range and the color-printing range. Alternatively, for example, different values of the threshold count N can be stored for different printing modes in the memory-for-determination 1220. More specifically, a first threshold count for multiple-color printing and a second threshold count for monochrome printing can be stored in the memory-for-determination 1220.

The color-printing determining unit 1260 determines which one of the printing modes has been selected based on the data that indicates a selected printing mode received from the control panel 128. Alternatively, this determination can be made as follows. When print data is transmitted to the MFP 5000 via a network or the like and received by the MFP 5000, the color-printing determining unit 1260 determines a type of the received print data, and selects one of the printing modes for the print data based on the determined type.

The comparative determining unit 1240 has, in addition to functions similar to those of the comparative determining unit 340, the following functions. The comparative determining unit 1240 determines that an Fb signal is anomalous when a pulse period of the Fb signal exceeds the color-printing range. The comparative determining unit 1240 also determines that an Fb signal is anomalous when a pulse period of the Fb signal exceeds the monochrome-printing range in a condition where the color-printing determining unit 1260 has determined that monochrome printing is to be performed.

Figure 13A:
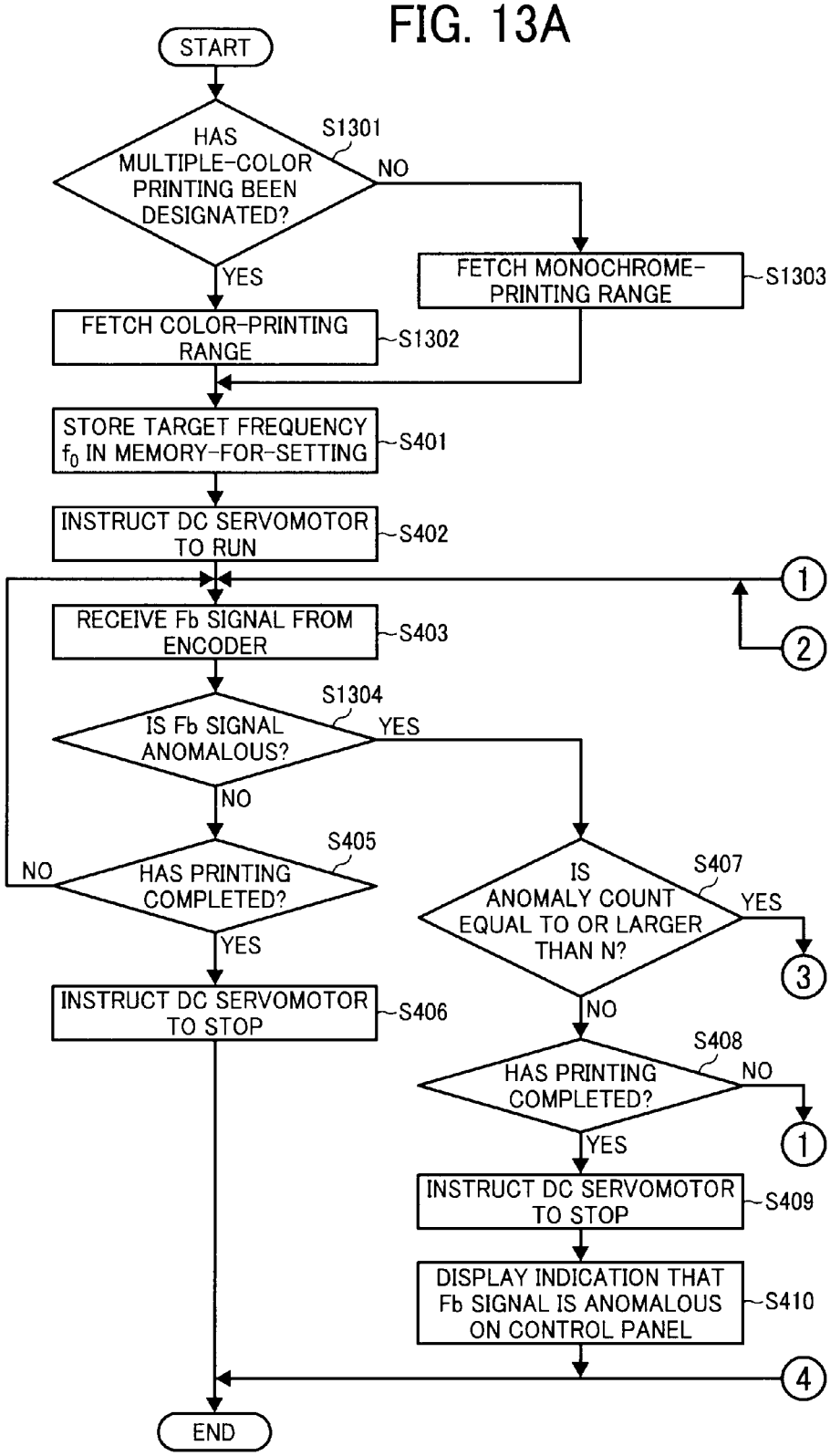
FIG. 13 is a flowchart of operations to be performed by the MFP according to the fifth embodiment before feedback control is switched.
Figure 13B:
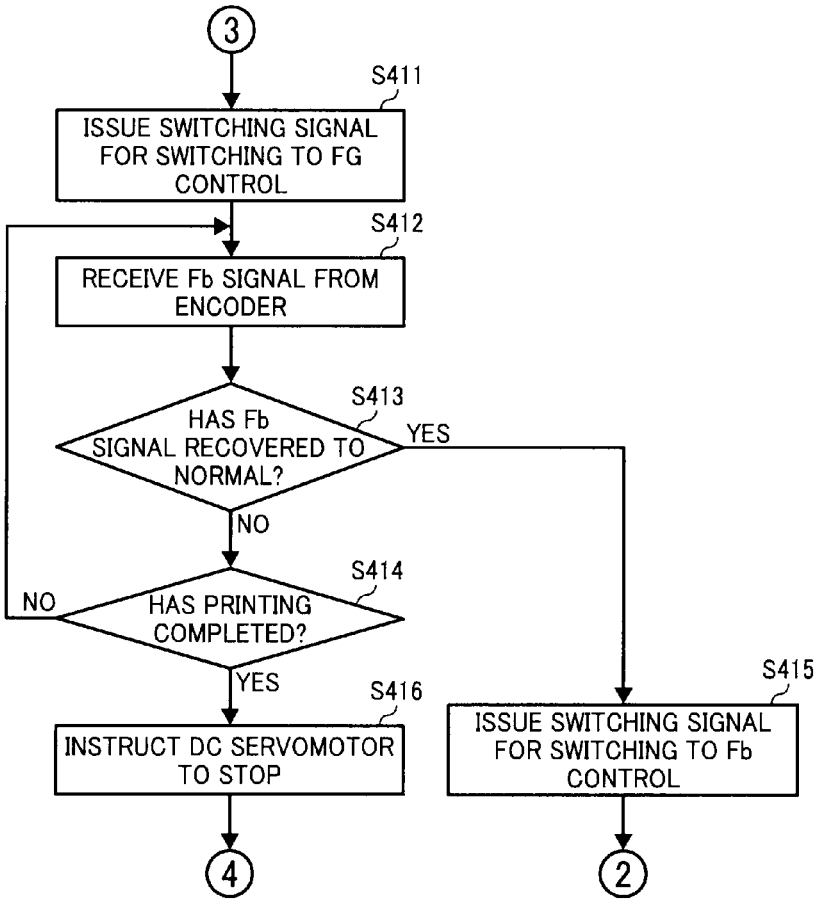
Figure 14:
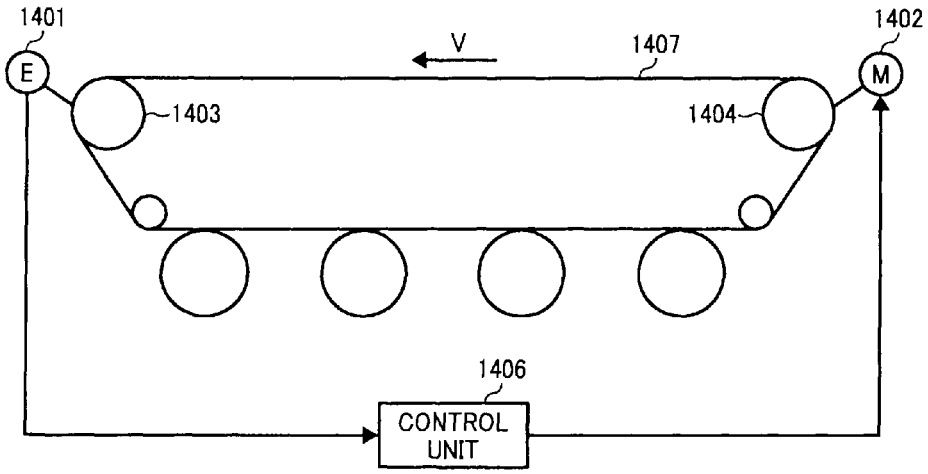
FIG. 14 is a schematic diagram of an MFP according to a conventional art.

How the MFP 5000 operates will be described below with reference to FIG. 13. The procedure performed by the MFP 5000 differs from that performed by the MFP 1000 only in that one of the period ranges is selected depending on printing mode. At other steps than steps related to this, the system control performed by the MFP 5000 is the same as that of the MFP 1000, the other steps are denoted by the same step numbers and repeated descriptions are avoided.

When an instruction for starting printing and a selected printing mode are entered by a user from the control panel 128, the color-printing determining unit 1260 determines whether multiple-color printing has been selected (Step S1301). If it is determined that multiple-color printing has been selected (Yes at Step S1301), the color-printing determining unit 1260 fetches the color-printing range from the memory-for-determination 1220 (Step S1302). If it is determined that monochrome printing has been selected (No at Step S1301), the color-printing determining unit 1260 fetches the monochrome-printing range from the memory-for-determination 1220 (Step S1303).

The comparative determining unit 1240 determines that the Fb signal is anomalous (Yes at Step S1304) when a pulse period of the Fb signal is out of a corresponding one of the color-printing range or the monochrome-printing range. When the anomaly count has exceeded the threshold count N (Yes at Step S407), the switching unit 330 transmits to the FG control unit 430 a switching signal for switching the feedback control to the FG control (Step S411).

In this manner, the comparative determining unit 340 determines whether the encoder 1 is anomalous based on the period range of a corresponding one of the printing modes selected by the color-printing determining unit 1260. Accordingly, while the feedback control is switched to the FG control immediately in monochrome printing, the Fb control is performed longer in multiple-color printing than in the monochrome printing. Because the feedback control is switched depending on a selected one of the printing modes even when the encoder 1 is detected to be anomalous in this manner, both forming high-quality images and smooth printing can be attained.

A computer program product (hereinafter, "the computer program") that is to be executed by each of the MFPs 1000 to 5000 is preloaded in a read only memory (ROM) or the like. The computer program can alternatively be stored in a computer-readable recording medium in an installable or executable file format. Examples of the computer-readable recording medium include a compact disc-read-only memory (CD-ROM), a flexible disk (FD), a compact disk recordable (CD-R), and a digital versatile disk (DVD).

The computer program can be stored in a computer connected to a network such as the Internet so that the computer program can be downloaded from the computer via the network. Alternatively, the computer program can be distributed to the MFPs 1000 to 5000 via a network such as the Internet.

The computer program is made up of modules, such as the target setting unit, the switching unit, and the comparative determining unit. In an actual hardware configuration, a central processing unit (CPU) reads the computer program from the recording medium, such as a ROM, and executes the computer program to load the target setting unit, the switching unit, and the comparative determining unit in the main memory.

According to an aspect of the present invention, even when a detecting unit is determined to be anomalous, feedback control of a conveying speed of a conveyer member is switched from a conveying-speed feedback control performed by a first control unit to a rotation-speed feedback control performed by a second control unit. This makes it advantageously possible to control the conveying speed of the conveyer member without stopping conveyance.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a conveyer-member control device that controls a conveying speed of a conveyer member; and an image forming unit that forms an image on the conveyer member, wherein the conveyer-member control device includes a detecting unit that detects a conveying speed of the conveyer member, a driving unit that drives the conveyer member, a first control unit that performs a first feedback control of the conveying speed based on the detected conveying speed and a predetermined target conveying speed, a second control unit that detects a rotation speed of the driving unit and performs a second feedback control of the rotation speed based on the detected rotation speed and a predetermined target rotation speed, a determining unit that determines whether the detecting unit is anomalous based on the detected conveying speed while the first feedback control is performed, and a switching unit that switches, when the determining unit determines that the detecting unit is anomalous, from the first feedback control to the second feedback control, the image forming apparatus further comprising an operation display unit that displays thereon either one of the first feedback control and the second feedback control which is currently performed, and receives an instruction from a user for switching the feedback control from the first feedback control to the second feedback control, wherein when the instruction is received by the operation display unit, the switching unit switches from the first feedback control to the second feedback control.

2. The image forming apparatus according to claim 1, further comprising:

a job detecting unit that determines whether a printing process of a print job is completed, wherein the switching unit switches from the first feedback control to the second feedback control both when the determining unit determines that the detecting unit is anomalous and when the job detecting unit determines that the printing process is completed.

3. The image forming apparatus according to claim 2, further comprising:

a switching determining unit that determines, when the determining unit determines that the detecting unit is anomalous, whether to switch from the first feedback control to the second feedback control after completing the printing process, wherein when the determining unit determines that the detecting unit is anomalous and when the switching determining unit determines to switch from the first feedback control to the second feedback control without waiting a completion of the printing process, the switching unit switches from the first feedback control to the second feedback control immediately, and when the determining unit determines that the detecting unit is anomalous and when the switching determining unit determines to switch from the first feedback control to the second feedback control after completing the printing process, the switching unit switches from the first feedback control to the second feedback control when the job detecting unit detects the completion of the printing process.

4. The image forming apparatus according to claim 1, further comprising:

a page detecting unit that determines whether a printing process of a page is completed, wherein the switching unit switches from the first feedback control to the second feedback control both when the determining unit determines that the detecting unit is anomalous and when the page detecting unit determines that the printing process is completed.

5. The image forming apparatus according to claim 1, further comprising:

a color-printing determining unit that determines whether the image is a color image or a monochrome image, wherein the detecting unit further detects a pulse signal corresponding to the conveying speed, and the determining unit determines that the detecting unit is anomalous in either one of a case where the image is a color image and a pulse period of the pulse signal exceeds a first range set for a plurality of colors, and a case where the image is a monochrome image and the pulse period exceeds a second range set for a single monochrome color.

6. The image forming apparatus according to claim 5, wherein the second range is wider than the first range.

7. The image forming apparatus according to claim 1, further comprising:

a counting unit that counts a number of times that the determining unit determines that the detecting unit is anomalous, wherein the switching unit switches from the first feedback control to the second feedback control when the number of times exceeds a predetermined threshold.

8. The image forming apparatus according to claim 1, further comprising:

a storage unit that stores therein state information indicating a state of a feedback control, wherein when the switching unit switches from the first feedback control to the second feedback control, the switching unit stores the state information indicating that the feedback control is switched to the second feedback control in the storage unit, and when the image forming apparatus is restarted, the feedback control is performed by either one of the first feedback control and the second feedback control based on the state information stored in the storage unit.

9. The image forming apparatus according to claim 1, wherein the detecting unit further detects a pulse signal corresponding to the conveying speed, the determining unit further determines, while the first feedback control is performed, whether the pulse signal is anomalous based on whether a pulse period of the pulse signal falls within a predetermined range, and when it is determined that the pulse signal is anomalous, further determines whether the pulse signal is recovered to normal, and when determining unit determines that the pulse signal is recovered to normal, the switching unit switches from the second feedback control to the first feedback control.

10. The image forming apparatus according to claim 1, wherein the operation display unit further displays thereon a status of image forming, and when the determining unit determines that the detecting unit is anomalous, the switching unit causes the operation display unit to display an error message.

11. The image forming apparatus according to claim 1, wherein the detecting unit further detects a pulse signal corresponding to the conveying speed, the first control unit performs the first feedback control by using the pulse signal, and the determining unit determines that the detecting unit is anomalous when a pulse period of the pulse signal exceeds a predetermined range.

* * * * *